US005915558A

United States Patent [19]

Girvetz

[11] Patent Number: 5,915,558

[45] Date of Patent: Jun. 29, 1999

[54] PORTABLE PILL BOX WITH ALARM

[76] Inventor: Nina Girvetz, 2913 Third St., Unit 310, Santa Monica, Calif. 90405

[21] Appl. No.: 09/015,450

[22] Filed: Jan. 29, 1998

[51] Int. Cl.[6] ..... B65D 83/04; B65D 39/02

[52] U.S. Cl. ..... 206/534; 224/240; 368/10

[58] Field of Search ..... 206/534; D3/215; 224/587, 269, 240, 241, 667, 930

[56] References Cited

U.S. PATENT DOCUMENTS

| | | | |
|---|---|---|---|
| D. 232,523 | 8/1974 | Nudell . | |
| D. 257,584 | 12/1980 | Finkel . | |
| D. 329,945 | 10/1992 | Benskin . | |
| D. 339,286 | 9/1993 | Kelsey et al. . | |
| D. 348,562 | 7/1994 | Smith | D3/215 |
| 2,492,864 | 12/1949 | Hermani . | |
| 2,982,454 | 5/1961 | Wolberg | 224/241 |
| 4,078,660 | 3/1978 | Lerro | 206/534 |
| 4,890,741 | 1/1990 | Edelstein | 206/534 |
| 4,901,852 | 2/1990 | King . | |
| 4,940,963 | 7/1990 | Gutman et al. . | |
| 5,153,582 | 10/1992 | Davis . | |
| 5,200,891 | 4/1993 | Kehr et al. . | |
| 5,289,157 | 2/1994 | Rudick et al. . | |
| 5,412,372 | 5/1995 | Parkhurst et al. . | |
| 5,488,571 | 1/1996 | Jacobs et al. . | |
| 5,535,147 | 7/1996 | Jacobs et al. . | |
| 5,570,297 | 10/1996 | Brzezinski et al. . | |
| 5,573,109 | 11/1996 | Isacson . | |
| 5,602,802 | 2/1997 | Leigh-Spencer et al. . | |
| 5,613,236 | 3/1997 | Tajima et al. | 224/269 |

OTHER PUBLICATIONS

Pager Holster, SEER, Inc. P.O. Box 20983, Waco, TX 76702–0983, Nov. 1993.

*Primary Examiner*—Paul T. Sewell
*Assistant Examiner*—J. Mohandesi
*Attorney, Agent, or Firm*—Darby & Darby

[57] ABSTRACT

A pill box having a shape which insinuates a pager is disclosed. The pill box has an alarm clock within a first enclosed space and a door which provides access to a second enclosed space in which pills are stored and retrieved. In one arrangement, a sensor detects movement of the door and the alarm is sound in response to the sensor. The pill box may be provided in combination with a pager of the type which includes circuitry for receiving a page signal and a display for displaying information including the page signal.

16 Claims, 2 Drawing Sheets

PORTABLE PILL BOX WITH ALARM

FIELD OF THE INVENTION

This invention relates to portable pill boxes, and more particularly to a pill box construction which is disguised to look like another object, for example, a pager.

BACKGROUND OF THE INVENTION

Pill boxes of many shapes and sizes are known in the art. A variety of pills are toted in pill boxes including, among others, vitamins and medications. Depending on an individual's medical circumstance, following a strict regimen of taking certain pills at particular times may be vital to continued treatment. To better ensure that pills are taken at the appropriate time, some pill boxes have been provided with alarms. See, e.g. U.S. Pat. Nos. 5,200,891 of Kehr et al. and 5,2879,157 of Rudick et al. However, there are individuals who prefer to keep their pill regimen a secret, particularly at work when surrounded by colleagues who may hear the alarm and question it. Colleagues may perceive the individual's need to take pills as a frailty or weakness, and the individual may be embarrassed by the revelation of his or her need to take pills.

What is needed in the art and has heretofore not been provided is a pill box construction that is disguised in the form of some other article, such as a pager. My invention satisfies that need and other needs, as described herein below.

SUMMARY OF THE INVENTION

According to one aspect of my invention, a pill box construction includes first and enclosed spaces, one of which houses an alarm clock and the other is configured to store pills for later retrieval. A door provides access to the pill storage space. A clip is provided to attach the pill box to an article of clothing or the like. The alarm can automatically program itself to set subsequent alarm times in accordance with an interval setting.

In accordance with a salient aspect of my invention, the pill box assumes the form of another, recognizable object to disguise its true identity. Preferably, the pill box is shaped so that upon casual inspection, it has the appearance of a pager.

Also, in accordance with another aspect of the invention, the pill box is combined with a pager. The combined unit provides the additional advantages of being able to transmit compliance messages and a panic message, in addition to the functions of a conventional pager and that of my inventive pill box.

These and other aspects of the invention are perhaps better appreciated with reference to the detailed description of the preferred embodiments in conjunction with the accompanying drawings.

IN THE DRAWINGS

DETAILED DESCRIPTION OF A PREFERRED EMBODIMENT

Figure 1:
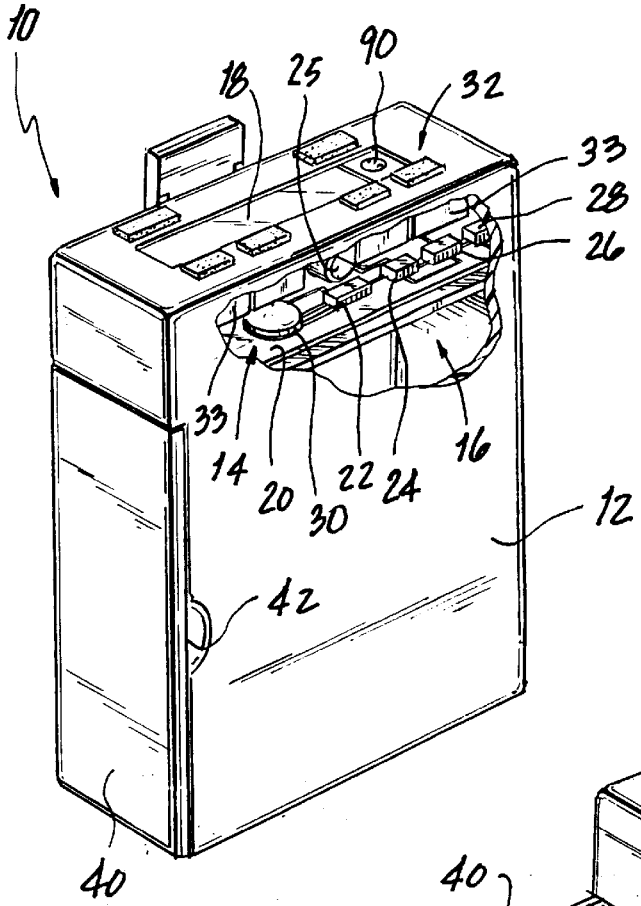
FIG. 1 is a front perspective view, partially broken away, of a pill box according to my invention with an access door in a closed position.

By way of overview and introduction, FIG. 1 illustrates a pill box in accordance with a preferred embodiment of my invention. Pill box 10 includes a housing 12 generally configured in the form of a pager. The housing 12 defines first and second enclosed spaces 14, 16 and includes a display 18 for displaying information such as the time, any alarm setting, and, for example, the pill to be taken when the alarm goes off. Within the enclosed space 14, there is a circuit board 20 which supports a clock circuit 22, an alarm module 24, an alarm 25, a programmed logic unit 26, and a memory 28, all interconnected in a conventional manner to support the functions described hereinbelow. A lithium battery 30 optionally can be used (for example, as a back-up battery) to maintain power to the components 20–28 at all times. On the surface of the housing, a plurality of buttons 32 (that selectively close switches 33) are provided for directing information to the display 18, and for entering information into the memory 28. The housing 12 includes a clip 30 on its rear surface which operates to selectively attach the pill box 10 to an article of clothing, etc., in a conventional manner.

In accordance with one aspect of my invention, the housing 12 illustrated in the Figures is configured to have the shape of a pager. That is, the pill box 10 has an external appearance similar to that of a paging device of the type having a generally rectangular box configuration (preferably with rounded corners) and a clip on a broad surface thereof. When combined with the clock circuit 22 and the alarm module 24 (i.e., an alarm clock), this pill box configuration alerts its holder that it is time to take a (particular) pill, yet persons in the room when the alarm is activated will not know that the pill box is anything other than a conventional pager. The clandestine nature of the housing 12, therefore, satisfies a privacy need while simultaneously alerting its holder that it is time to take a pill. Moreover, because it is common experience for someone being paged to step away to make a private call, the pager-like appearance of the pill box affords an excuse for the holder to step away and take the pill.

Figure 2:
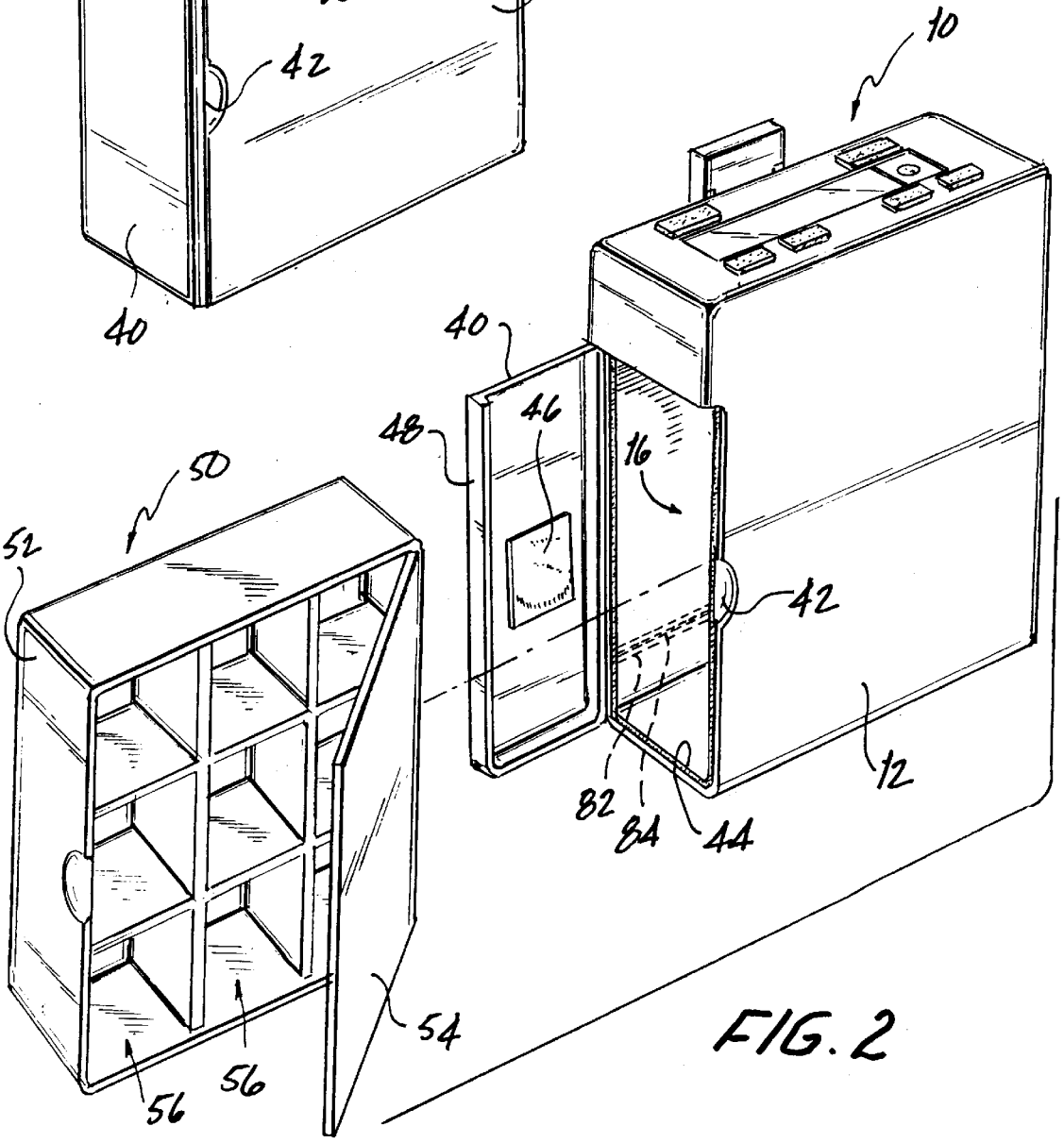
FIG. 2 is the pill box of FIG. 1 illustrating the access door in an open position and a drawer removed therefrom.

In sharp contrast to known pagers, the housing 12 has a second enclosed space 16 for storing pills and the like. By "pill," I mean any digestible vitamin, mineral, or medicament in an oral dosage form, such as a tablet, microtablet, or a capsule containing a liquid, powder and/or pills or microtablets. With reference now to FIGS. 1 and 2, there is seen an access door 40 which is selectively movable between a first, closed position (as shown in FIG. 1) and a second, opened position (as shown in FIG. 2). In the preferred configuration of FIGS. 1 and 2, a finger groove 42 exposes an edge of the access door 40 so that the door can be pried to the second, opened position. Other arrangements for the access door 40 are within the scope of the present invention, for example, by way of illustration and not limitation, the arrangements disclosed in co-pending U.S. Pat. Nos. Des. 394,347 and Des. 399,649 and Des. 400,006, all three having been filed by me on Jun. 2, 1997, the disclosures of which are hereby incorporated by reference as if set forth in their entireties herein.

Preferably, a moisture-tight seal is established between the housing 12 and the access door 40 when the access door is in the closed, first position to protect any pills stored therein from moisture or liquids. A gasket 44 is preferably provided as a seal along the surfaces that join the closed door 40 and the housing 12, supported on either or both surfaces. The gasket 44 may be attached by an adhesive, or applied in the form of a spray as a silicon or foam layer. Further, a drying agent or desiccant may be provided within the enclosed space 16, for example within a pouch 46, to maintain or stabilize a low humidity environment within the pill box 10.

Pills may be stored directly within the enclosed space 16. However, to avoid spilling the contents of the pill box 10 in the event that the access door 40 opens inadvertently, and in accordance with another aspect of my invention, a drawer or vial 50 is housed within the space 16 and is only removable when the access door 40 is moved to its fully open position (see FIG. 2). A lip 48 on the access door 40 catches the forward edge 52 of the drawer 50 if the door 40 is not fully open. The drawer preferably has a lid 54, and one or more compartments 56 therein for storing pills, although this is not required. If a drawer or vial 50 is provided with a lid 54, then the moisture-tight seal can be provided between the drawer 50 and the lid 54 instead, of or in addition to, the seal between the door 40 and the housing 12. Plural drawers or vials 50 may be stored in the housing 12 of various sizes and shapes subject only to the space constraint imposed by the size of the enclosed space 16; only one drawer or vial is illustrated in the Figures.

With reference again to FIG. 1, the buttons 32 can be used to program the clock circuit 22 to the correct time, the alarm module 24 to sound at one or more predetermined intervals, and the display 18 to display which pill is to be taken at particular times (or in response to actuation of the alarm) . The circuitry supported on the circuit board 20 supports an array of functions particularly suited to the needs of individuals or parents that have to implement an oral dosage regimen. The clock circuit 22 keeps track of the time of day and, optionally, the date. The clock is set by putting the circuitry into the set mode, for example, by pressing a particular button 32 or holding the button for a predetermined period of time, and then adjusting the time in a conventional manner until the correct time is displayed on the display 18. As can be seen in FIG. 2, below each button 32 is a conventional normally-open switch 33, configured to close a circuit on the circuit board 20 only for as long as the button 32 is pressed. The programmed logic unit 26 responds to changes in the switch positions by changing or setting the time, or changing or setting any of the other features of the pill box 10 described herein.

The alarm module 24 drives an alarm 25 (for example, a piezoelectric element, buzzer or vibrator) in response to one or more alarm settings to notify the holder that it is time to take (or administer the taking of) a pill. Each of preferably several alarms is set in substantially the same way as the clock to a preset alarm time, and each setting is stored in the memory 28. For each alarm time set, the quantity and type of pills to be taken is preferably set as well. To facilitate programming, the interval between taking each type of pill may be entered so that, in combination with the clock circuit 22, the pill box 10 automatically programs itself to actuate the alarm 25 at the appropriate time, using the interval information to ensure that at least the next alarm setting is available in the memory 28.

For example, if ibuprofin is to be taken every four hours on the hour, then assuming that the first pill is to be taken at twelve o'clock, the alarm is set for twelve o'clock, the user scrolls through alphanumeric characters to enter "one ibuprofin", and then enters the interval of four hours. The programmed logic unit 26 stores in the memory 28 the entered information and, when the clock indicates twelve o'clock, the alarm sounds, indicating that an ibuprofin pill is to be taken, and the memory 28 is updated with the next alarm time using the interval information. Specifically, the next alarm setting will automatically be set to 4:00 p.m. to indicate one ibuprofin is to be taken at that time. If the prescription called for taking a tablet X number of times daily, the interval can be calculated by the programmed logic unit 26 as being equal to 24 hours divided by X. Data entry into the pill box 10 is menu driven by the buttons 32 in a conventional manner.

The programmed logic unit 26 compares the present time (as maintained by the clock circuit 22) with any alarm settings that have been stored in the memory 28, regardless of whether the alarm setting was entered manually using the buttons 32, remotely using wireless link to a personal computer or the like (described below), or calculated automatically using interval information. When the preset time for a particular alarm setting has been reached, the alarm module 24 actuates the alarm 25. Then, if an interval has been entered the next alarm time setting is automatically calculated and placed in the memory 28.

In accordance with a preferred feature of my invention, the display 18 identifies the pill to be taken when the alarm sounds. The pill can be identified by an alphanumeric display in the display 18 (e.g., "one Vitamin B12 with water") or by a color or number code. In the case of a color or number code, each alarm is assigned the code (e.g., alarm one or alarm two) and the pills are housed within the pill box 10 in corresponding slots 56 (e.g., slots one and two, respectively). Similarly, if pills are placed in a "red" slot, then the time, quantity, and interval (frequency) that those pills are to be taken are programmed with regard to the alarm code "red."

Also, using the buttons 32, the display 18 can be configured to continuously, periodically, or selectively display the next pill to be taken, or other statistical information (for example, how many of one or all types of pills have been taken, still need to be taken, and what pills are needed to replenish the pill box 10 for a new day). The programmed logic unit 26 implements such programs by selecting a display mode using the buttons 32.

Figure 3:
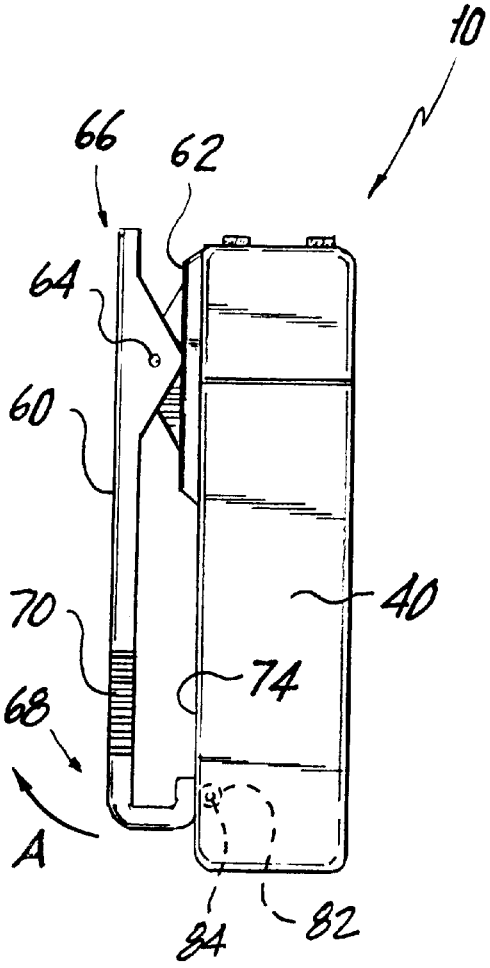
FIG. 3 is a left side elevational view of FIG. 1.
Figure 5:
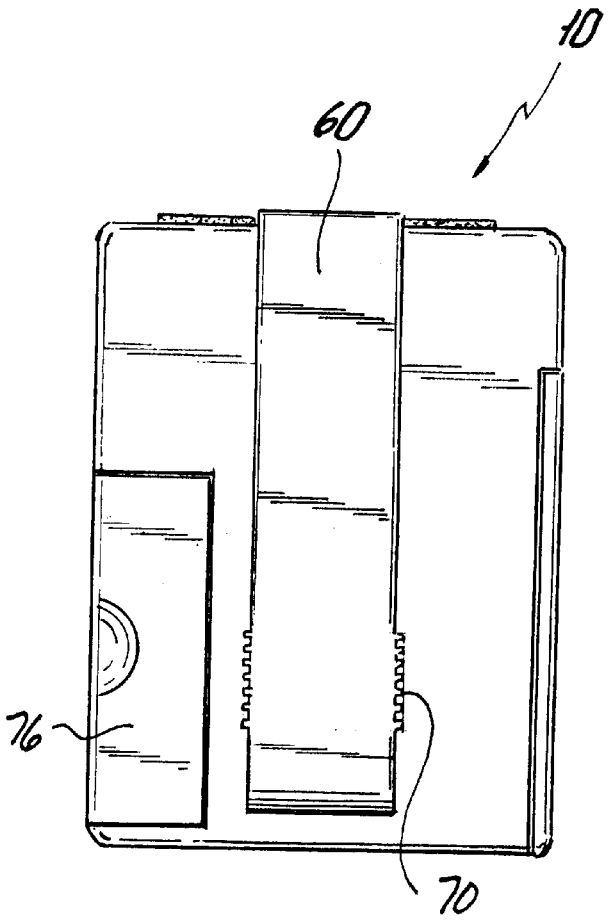
FIG. 5 is a rear elevational view of FIG. 1.
Figure 4:
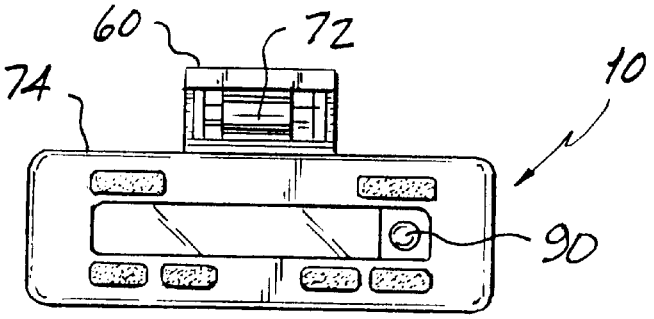
FIG. 4 is a top plan view of FIG. 1.

With reference now to FIGS. 3–5, a clip 60 is shown pivotally attached to the housing 12 by a mount 62 and a pivot pin 64 disposed near a first end 66 of the clip 60. At opposite end 68 of the clip, a grasping surface 70 is biased by a spring 72 to normally abut a rear surface 74 of the housing 12. The clip 60 is movable in the direction of arrow A against the urging force of the biasing spring 72 to permit the pill box 10 to be attached to an article of clothing or the like. As will be appreciated, the inclusion of the clip 60 assists the pill box in insinuating a pager.

In accordance with another feature of my invention, the housing includes a lock mechanism which cooperates with movement of a clip 60 to prevent inadvertent opening of the access door 40. The access door 40 has along one margin a flange 80 having an aperture 82 therein. A pull wire or rod 84 (see FIG. 3) is selectively received within the aperture 82 whenever the clip 60 is rotated such that the abutment surface 70 no longer contacts the rear surface 74 of the housing 12. When the clip 60 is in the position shown in FIG. 3, the pull wire 84 is retracted from the flange 80 and the access door 40 can be opened.

As an additional measure of protection against inadvertent spillage of pills, a sensor can be provided to detect the opening of the door 40. For example, the door 40 may have a metal contact that, when in the closed position, contacts a corresponding contact on the housing and thereby closes a circuit. Circuitry on the circuit board 20, for example, driven by programmed logic unit 26, detects any discontinuity in the circuit path between the contacts on the door and the housing, and sounds the alarm 25 to alert the user that the door has opened. Of course, the alarm 25 can be disabled when the door is opened within a predetermined time period after the alarm 25 has sounded in response to an alarm time setting.

Also shown in FIG. 5, a battery compartment is accessed by the door 76. A conventional triple-A sized battery may be used as a primary power source for the circuit components 20–28 of the pill box 10.

It is within the scope of my invention to include the second enclosed space 16 for storing and retrieving pills within the housing of a conventional pager. Such a combination provides all of the advantages of my inventive pill box as well as the known benefits that pagers provide. The combination includes the alarm clock circuitry described above, as well as the clip 60, and additionally includes circuitry for receiving a page signal, a display for displaying information including the page signal, and a button. Circuitry which is suitable for implementing the conventional pager functions of this combination is disclosed in U.S. Pat. Nos. 4,940,963 of Gutman and 5,153,582 of Davis, both assigned to Motorola Inc. of Schaumburg, Ill. the disclosures of which are hereby incorporated by reference as if set forth in their entireties herein. The pager and alarm circuitry can be housed in a first compartment (e.g., the first enclosed space 14 of FIG. 1), separated from a second compartment (e.g., the second enclosed space of FIG. 1) in which pills are stored and later retrieved. As in the previous description, an access door 40 is provided, and, preferably, a gasket 44 is provided as well.

When combined with a conventional pager, programming of the alarm module 24 can be accomplished by sending a pager message to the pill box 10. A program running on a conventional personal computer can address the pill box 10 by causing a modem to dial a telephone number that addresses a particular pill box/pager 10' and broadcast an appropriate message ("take Ibuprofin now"). The message is transmitted in conventional broadcast manner and the particular pager that is addressed will respond to the message by actuating the alarm 25 and displaying the message sent from the personal computer on the display 18.

Also, instead of using the buttons 32 to program the alarm 25, a sensor 90 may be provided on the housing 12 to read flashing bars of light from a monitor connected to the personal computer. The flashing bars of light represent data being transferred from the personal computer into the memory 28 of the pill box 10. The programmed logic unit 26 responds to the data that has been entered into the memory 28 via the sensor 90 in the same manner as described above. Suitable circuits for accomplishing the data link using the sensor 90 are disclosed in U.S. Pat. Nos. 5,570,297, 5,535,147, and 5,488,571, each assigned to Timex Corporation, which are hereby incorporated by reference as if set forth in their entireties herein.

Compliance can be monitored at a central station by transmitting an automatic acknowledge signal of two varieties each time that the alarm sounds. If the pills are accessed (door 40 is opened and/or a vial is removed), then the acknowledge signal will indicate that the contents of the pill box have been accessed in response to the alarm signal. If the pills are not accessed within a set period of time after the alarm sounds, a different acknowledge signal is transmitted indicating that the pills were not accessed and that patient compliance is questionable. The encoded acknowledge signals of the aforesaid Davis patent can be used in this regard, with the programmed logic unit 26 monitoring whether the door has been opened (e.g., monitoring the contacts on the door and the housing to detect interruption) and, in response, selecting the appropriate encoded acknowledge signal to transmit.

If the door has not been opened in response to the alarm, the alarm may continuously or periodically re-sound to foster patient compliance.

The central station may be, for example, a local or central computer, a doctor's office or HMO, hospital, pharmaceutical or insurance company, research facility or Government agency. The encoded message can be relayed to a computer and forwarded to any one of the above locations.

Also, one of the buttons 32 can initiate a panic routine, using a program executed by the programmed logic unit 26, so that an encoded message is sent to a central station. The encoded message can be formulated at the pill box 10 using a menu driven routine, or can be a pre-programmed message.

For those who must take drugs in exact accordance with a schedule, it is burdensome to keep track of what drug needs to be taken and in what quantity. There is more to day-to-day life than thinking about when the last dose was taken and when the next one is to be taken. My invention lifts that burden, and stores a sufficient quantity of pills so that one can go about his or her business knowing that they have all of the drugs they need with them, have a device that will remind them when to take them, and advise as to which pills must be replaced at the end of the day or the beginning of a new day. By removing reliance on the patient's memory, there is less risk of over- or under-medicating.

From the foregoing description, it will be clear that the present invention may be embodied in other specific forms without departing from the spirit or essential characteristics thereof. Thus, while the foregoing description has been directed, in part, to a pill box in the form of a pager, which is the presently preferred mode, the invention is not so limited. The presently disclosed embodiment is therefore to be considered in all respects as illustrative and not restrictive, the scope of the invention being indicated only by the appended claims.

I claim:

1. A pill box, comprising:

a housing having a first enclosed space and a second enclosed space, the housing having a broad surface being shaped to insinuate a pager;

an alarm clock within the first enclosed space having an alarm;

a door operable to selectively provide access to the second enclosed space for storing and retrieving pills;

a clip pivotally attached to the housing on the broad surface thereof;

a sensor means for detecting movement of the door; and means responsive to the sensor means for actuating the alarm.

2. The pill box as in claim 1, further comprising a drawer or vial receivable in said second enclosed space.

3. The pill box as in claim 1, wherein the alarm clock includes one of a buzzer and a vibrator alarm.

4. The pill box as in claim 1, further comprising one or more buttons and a display.

5. The pill box as in claim 4, wherein the display identifies the pill to be taken.

6. The pill box as in claim 4, wherein the second enclosed space has coded slots or vials.

7. The pill box as in claim 6, wherein the code comprises a number and wherein the display displays the number.

8. The pill box as in claim 6, wherein the code comprises a color and wherein the display displays the color.

9. The pill box as in claim 1, further comprising a gasket disposed relative to said door and said housing to seal the second enclosed space when the door is in a closed position.

10. The pill box as in claim 1, further comprising a desiccant within the second enclosed space.

11. The pill box as in claim 1, wherein the alarm clock includes an interval setting which automatically sets the alarm at the set interval.

12. In combination, a pager and a pill box comprising:

a housing having first and second interior compartments, the housing having a broad surface and being shaped to insinuate a pager;

a clip pivotally attached to the exterior of the housing on the broad surface thereof;

a pager within the first compartment, the pager including circuitry for receiving a page signal, a display for displaying information including the page signal, and a button;

an alarm clock within the housing having an alarm;

a door movable between a first position in which the second interior compartment is closed and a second position in which the second interior compartment is open;

a sensor means for detecting movement of the door from the first position to the second position; and means responsive to the sensor means for actuating the alarm.

13. The pager as in claim 12, wherein the pager includes acknowledge signal means for transmitting a first encoded acknowledge signal to a central station if the door is moved from the first position within a set period of time after the alarm has been actuated and a second encoded acknowledge signal to a central station if the door is not moved from the first position within a set period of time after the alarm has been actuated.

14. The pill box as in claim 1, further comprising:

a lock means which cooperates with movement of the clip for preventing inadvertent opening of the door, the lock means including a pull wire which is received in the slot to prevent the door from opening when the clip is in a first position and which is retracted from the slot when the clip is in a second position to permit the door to open.

15. In combination, a pager and a pill box comprising:

a housing having first and second interior compartments, the housing having a broad surface and being shaped to insinuate a pager;

a clip pivotally attached to the exterior of the housing on the broad surface thereof;

a pager within the first compartment, the pager including circuitry for receiving a page signal, a display for displaying information including the page signal, and a button;

an alarm clock within the housing having an alarm;

a door movable between a first position in which the second interior compartment is closed and a second position in which the second interior compartment is open; and a panic button for communicating an encoded message to a central station.

16. In combination, a pager and a pill box comprising:

a housing having first and second interior compartments, the housing having a broad surface and being shaped to insinuate a pager;

a clip pivotally attached to the exterior of the housing on the broad surface thereof;

a pager within the first compartment, the pager including circuitry for receiving a page signal, a display for displaying information including the page signal, and a button;

an alarm clock within the housing having an alarm; and a door movable between a first position in which the second interior compartment is closed and a second position in which the second interior compartment is open;

wherein compliance messages are automatically communicated to a central station indicative of a patient's compliance with a pill regimen.

* * * * *